US006988866B2

(12) United States Patent
Friedland et al.

(10) Patent No.: US 6,988,866 B2
(45) Date of Patent: Jan. 24, 2006

(54) FORK LIFT ATTACHMENT FOR MULTI-PURPOSE BUCKET

(75) Inventors: Kenneth R. Friedland, Centennial, CO (US); Charles Leroy Welch, Westminster, CO (US); Donna Kelleen Darnell, Boulder, CO (US)

(73) Assignee: Construction Technology, Inc., Denver, CO (US)

( * ) Notice: Subject to any disclaimer, the term of this patent is extended or adjusted under 35 U.S.C. 154(b) by 18 days.

(21) Appl. No.: 10/454,704

(22) Filed: Jun. 4, 2003

(65) Prior Publication Data

US 2003/0228210 A1 Dec. 11, 2003

Related U.S. Application Data

(60) Provisional application No. 60/386,288, filed on Jun. 5, 2002.

(51) Int. Cl.
*E02F 7/04* (2006.01)

(52) U.S. Cl. ..... 414/724; 37/405; 414/912

(58) Field of Classification Search ..... 414/724, 414/912; 37/403, 405

See application file for complete search history.

(56) References Cited

U.S. PATENT DOCUMENTS

| | | | | |
|---|---|---|---|---|
| 3,667,633 | A | 6/1972 | Cappella | |
| 3,908,844 | A * | 9/1975 | Duffield | 414/724 |
| 6,022,184 | A * | 2/2000 | Friedland | 414/724 |
| 6,287,070 | B1 | 9/2001 | Perry | |
| 6,527,497 | B2 * | 3/2003 | Perry | 414/724 |
| 6,547,508 | B2 | 4/2003 | Perry | |
| 6,641,347 | B2 * | 11/2003 | Ewington | 414/724 X |

* cited by examiner

*Primary Examiner*—Donald W. Underwood

(74) *Attorney, Agent, or Firm*—Henry L. Smith, Jr.

(57) ABSTRACT

A fork lift attachment for multi-purpose buckets that is easily installed and secured. The mechanism fits under the bucket and is supported by a slot on the top side of the tine and a latch at the heel of the tine. The latch is tightened causing the fork lift attachment to be cinched onto the bucket. A security chain readily and visibly secures the latch so as to prevent the fork lift attachments from being dislodged even if the hydraulics open the bucket.

17 Claims, 8 Drawing Sheets

20
24
22
50
34
30
14
32
8
28
2
13
35
26
10
33
40
36
44
42
6
12

20
22
50
34
14
8
2
13
10
33
40
36
12
42
6
44
37

FORK LIFT ATTACHMENT FOR MULTI-PURPOSE BUCKET

RELATED APPLICATIONS

This application claims the benefit of U.S. Provisional Patent Application Serial No. 60/386,288, filed on Jun. 5, 2002, which is incorporated herein by reference.

BACKGROUND OF THE INVENTION

1. Field of the Invention

This invention relates generally to the field of fork lift attachments to convert a multi-purpose bucket of a loader into a fork lift and more particularly to the field of doing so in a removable manner that is easy to install and does not damage the bucket.

2. Discussion of the Background

In the construction and agriculture industries loaders are often used as multi-functional pieces of equipment. Some of these loaders make use of a multi-purpose bucket in order to be more versatile and have one piece of equipment able to perform many tasks. These multi-purpose buckets are also referred to as 4-in-1 buckets or clam shell buckets. The bucket has two jaws that are pivotally mounted to each other with their positions relative to each other being controlled by hydraulic cylinders. The bucket is then otherwise operated and moved as any regular bucket would be on a loader.

There have been fork lift attachments for regular buckets, such as U.S. Pat. No. 6,022,184 to Friedland, wherein the attachments allow for the temporary conversion of a regular bucket to perform fork lift jobs. This conversion ability is very advantageous in that it allows a single piece of equipment to be used for different functions without a major investment in separate specialized equipment.

For multi-purpose buckets, prior fork lift attachments have relied upon cumbersome and sometimes unsecured means of attachment. Examples are illustrated by U.S. Pat. No. 3,667,633 to Cappella and U.S. Pat. Nos. 6,287,070, 6,527,497 and 6,547,508 to Perry. These designs have serious drawbacks. In practice the tips of the fork lift tine often are pushed upward, intentionally or unintentionally, creating forces that may dislodge the fork lift attachments. The result may be an insecure fork lift or dropped or damaged cargo which may cause personal injury or property damage. Inadvertent dropping of the fork lift attachment from the bucket can also occur if the jaws of the multi-purpose bucket open, even if only partially.

A second shortcoming of these prior designs is the components that are used. Some, such as in the Perry design, have large steel plates that must be placed in the bucket with attached T or I beams. These can weigh a significant amount, thus reducing the useable payload weight. In addition the large, heavy components necessarily cannot be easily installed by an individual and can pose difficulties in field installations. Further, the Perry design has an expensively fabricated tine component which is necessary in order to have the front of the tines be at ground level. The fabrication to obtain such a configuration while maintaining strength is very expensive and involved.

Another shortcoming of some designs is the use of semi-permanent bolts or other fasteners to secure the fork lift attachments to the bucket. Placement of holes or other similar permanent alterations to the bucket are not advisable, as it diminishes the integrity of the bucket and can initiate degradation or shortening of the life of the bucket. If the machine is a rental or loaned piece of equipment, such alterations are normally not permitted.

SUMMARY OF THE INVENTION

The present invention involves the easy mounting of the within fork lift attachment to convert the multi-purpose bucket of a loader into a fork lift. The attachment is very secure and reduces the risk of slippage or movement of the fork lift attachment while in operation, even if the multi-purpose bucket opens partially or is reverse loaded. The design is simple and the location of the tines on the underside of the bucket allows for easy mounting and use. The fork tines can be set on the ground and the bucket attached and secured by only a single person. There is no need to manually lift the attachment or any of its parts into or over the bucket for installation.

The attachment includes a security latch that is easily placed and readily visible to check for secure installation. Further, the latch acts to tighten the integration of the fork lift attachment to the bucket. The latch also acts as a load bearing structure to transfer forces to the most sturdy and rigid portions of the bucket, which are the leading edge of the upper jaw and rear and leading edge of the lower jaw of the bucket.

The installation does not damage the bucket as there are no holes or mounting plates required. Further the fork lift attachment can be easily moved and stored as its parts are compact. The fork lift attachment components themselves are simple in design and relatively inexpensive with no massive, heavy components, thus allowing for easy installation and maintenance.

BRIEF DESCRIPTION OF THE DRAWINGS

FIG. 1 also illustrates the fork lift attachment of the present invention secured to the bucket.

DETAILED DESCRIPTION OF THE INVENTION

Figure 1:
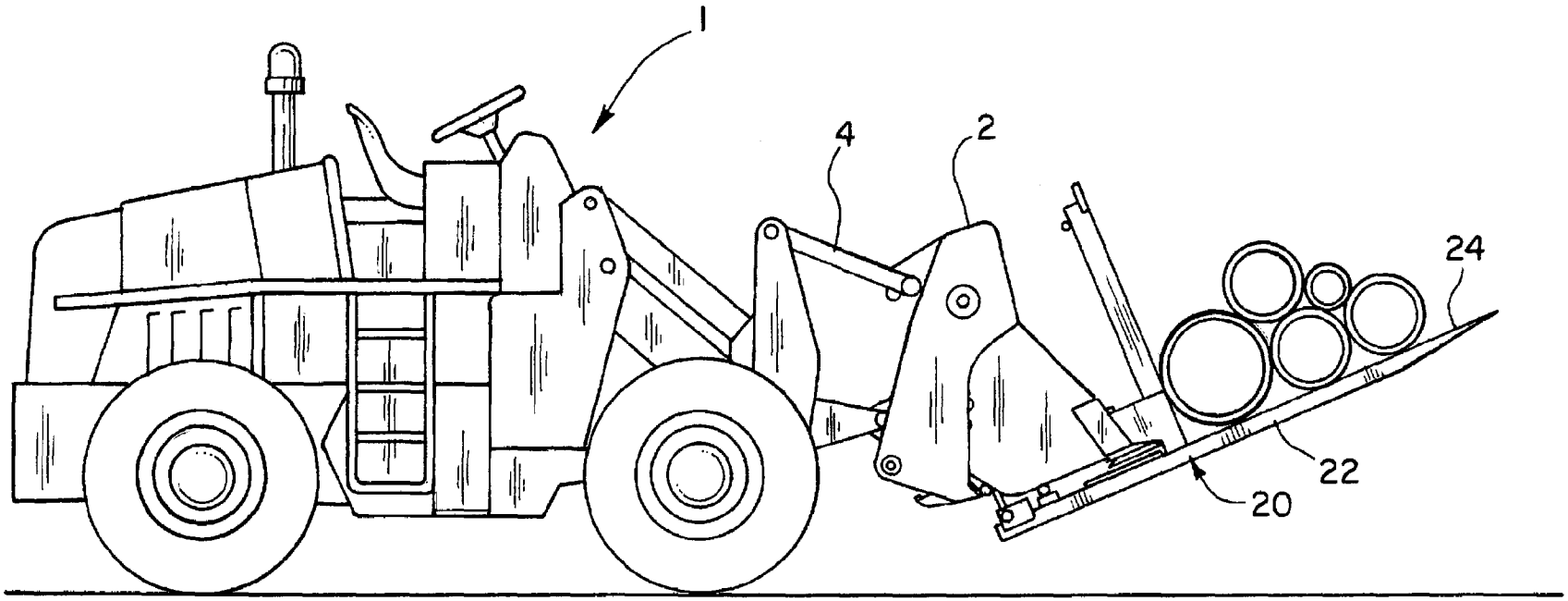
FIG. 1 illustrates a loader with a clamped multi-purpose bucket attached as it would essentially appear when being used as a loader bucket.
Figure 2:
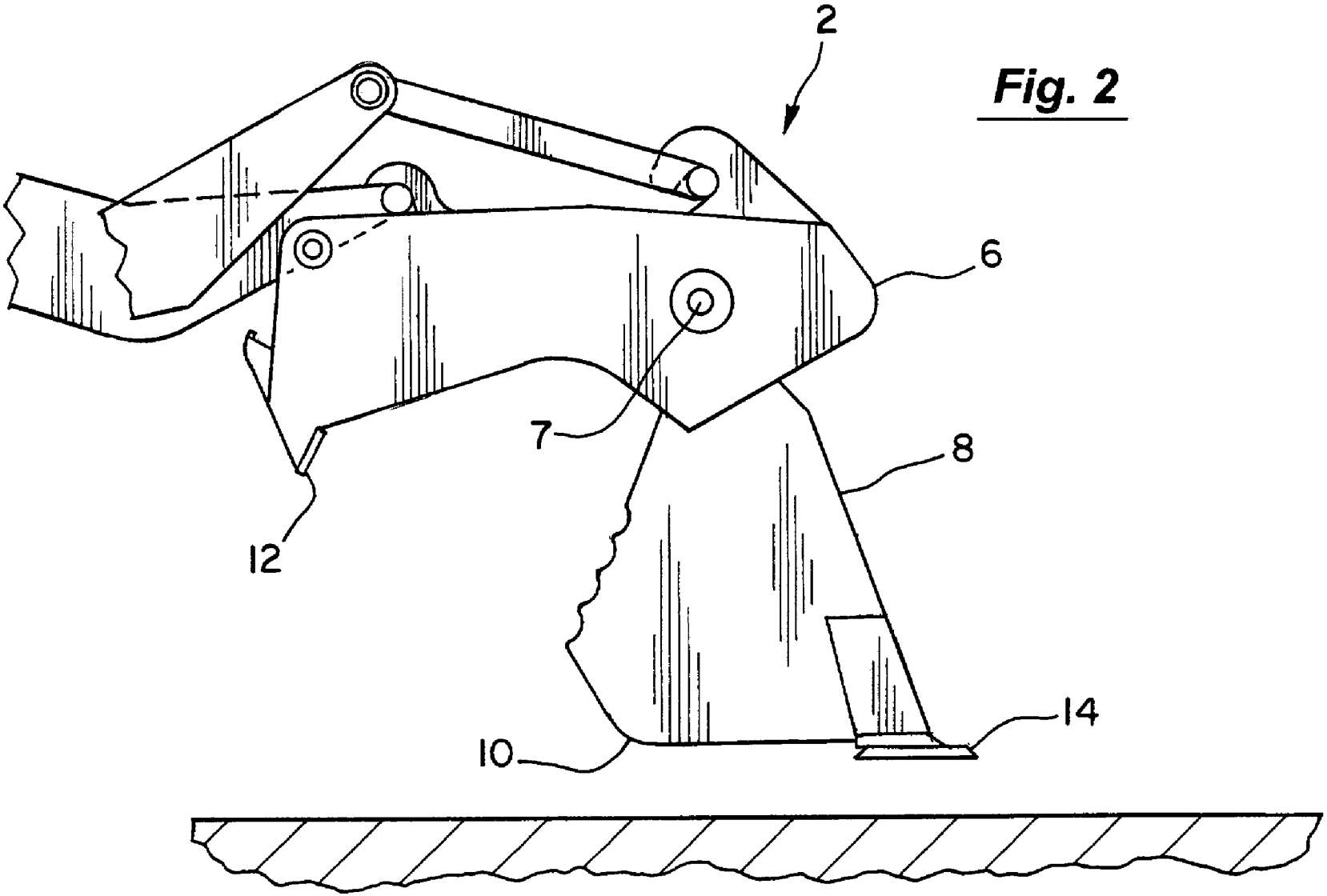
FIG. 2 illustrates a multi-purpose bucket opened showing the two major portions or jaws of this type of bucket.

FIG. 1 illustrates a multi-purpose bucket 2 on a typical loader 1. The bucket 2 as a whole is moveable on arms 4 as in such loaders 1. The bucket 2, as better seen in FIG. 2, has two major portions or jaws 6 and 8 that are pivotally mounted to each other at 7 and moveable relative to each other. In an opened position, the lower jaw 8 when raised allows the upper jaw 6 to be useable as a grader blade. The two jaws 6 and 8 in cooperation can also act as a claw for grasping and lifting and moving items in the field. In another configuration, the lower jaw 8 can act as a scraper for earth surface treatment. When the two jaws are closed without the fork attachment, it operates as a regular bucket. This versatility of such a typical multi-purpose bucket 2 is well known. However, the function that is not present without an attachment is the fork lift function. In the clamped position of FIG. 1, the rear edge 10 (see FIG. 2 again) of the lower jaw 8 meets the bottom edge 12 of the upper jaw 6 to form the bucket with the fork attachment 20 in FIG. 1 clamped between the two jaws of the bucket. The methods and attachments herein accomplish this extra functionality by the addition of a fork lift attachment 20 to the multi-purpose bucket 2 in an easy and secure manner that does not damage the bucket 2.

Figure 3:
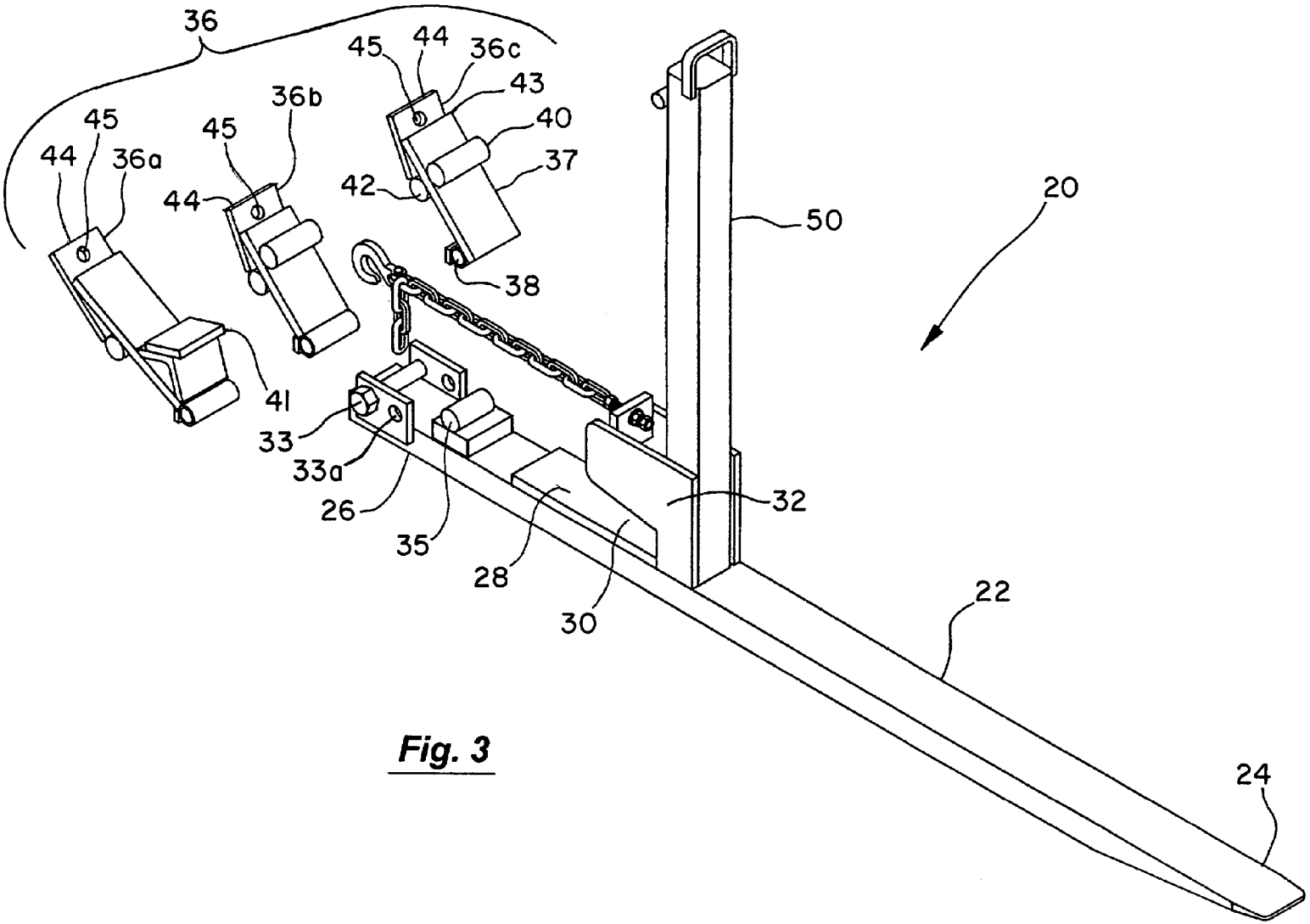
FIG. 3 illustrates one fork lift attachment with three alternative latch components that would be selected to be used with different types or brands of buckets.

FIG. 3 illustrates the fork lift attachment 20 of the present invention which can be installed on the multi-purpose bucket 2 and are usually installed in pairs. Each fork lift attachment 20 is comprised of a tine 22 that has a tip 24 and a heel 26. The fork lift attachment 20 also has a vertical extension 50 whose function as a cargo barrier will be more fully explained below. On the top side of the tine 22 is a slot 30 formed in part by member 32 positioned between the tip 24 and the heel 26. The slot 30 is also preferably formed in part by a base 28 which is on the top side of the tine 22 and below a portion of the member 32. A rear bearing point 35 is also provided on the top side of the tine 22 between the slot 30 and the heel 26 with a hinge point 33 being located on the heel 26 of the tine 22. A latch 36 is rotatably attached to the hinge 33 on the tine 22 and as shown in FIG. 3 may have different configurations including those of 36*a*, 36*b* and 36*c*. 36*a* is useable for John Deere multi-purpose buckets and Gannon Buckets. 36*b* is useable for Caterpillar and Komatsu multi-purpose buckets and 36*c* is useable for Case buckets. Most other multi-purpose buckets will use one of these three styles.

Figure 4:
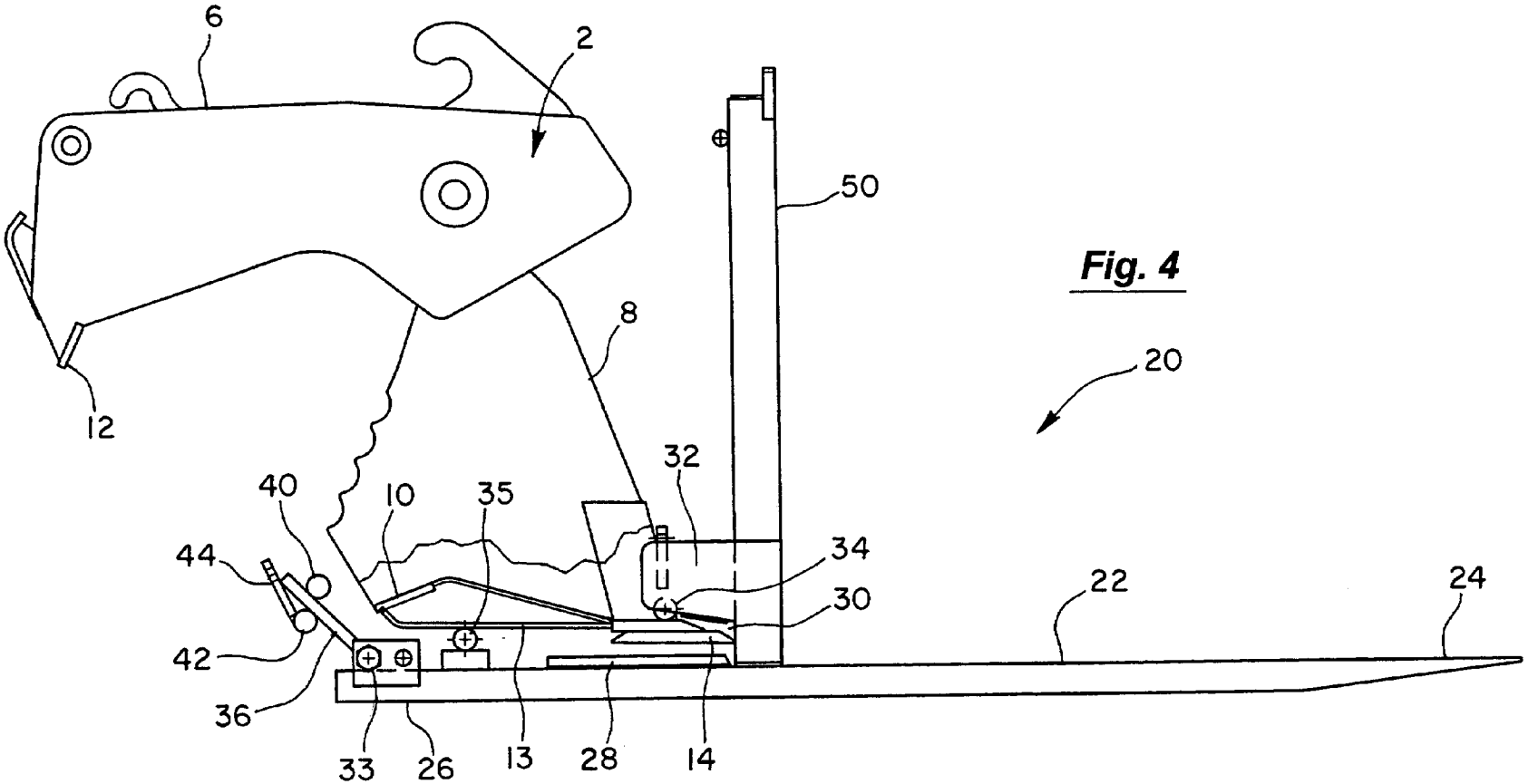
FIG. 4 illustrates a side view of a fork lift attachment along with the two jaws of the multi-purpose bucket as it is being positioned for installation.

FIG. 4 represents a side view of the fork lift attachment 20 resting on a surface, such as the ground. As the tine 22 nests on the bottom of the bucket when installed, there is no need to manually lift the tine 22 onto or into the bucket.

FIG. 4 further illustrates that when initially joining the bucket 2 and fork lift attachment 20, the jaws 6 and 8 of the bucket 2 are opened and the entire bucket 2 is rotated forward. This allows the bottom jaw 8 to engage the fork lift attachment 20 (similar to slipping a foot into a slipper). The operator places the leading edge 14 of the bottom jaw 8 in the slot 30 between the top member 32 and the base 28. The bottom surface 13 of the bottom jaw 8 of the bucket 2 rests on the rear bearing point 35. The rear edge 10 of the bottom jaw 8 when in place is approximately even with the hinge 33 on the heel 26 of the tine 22.

Figure 5:
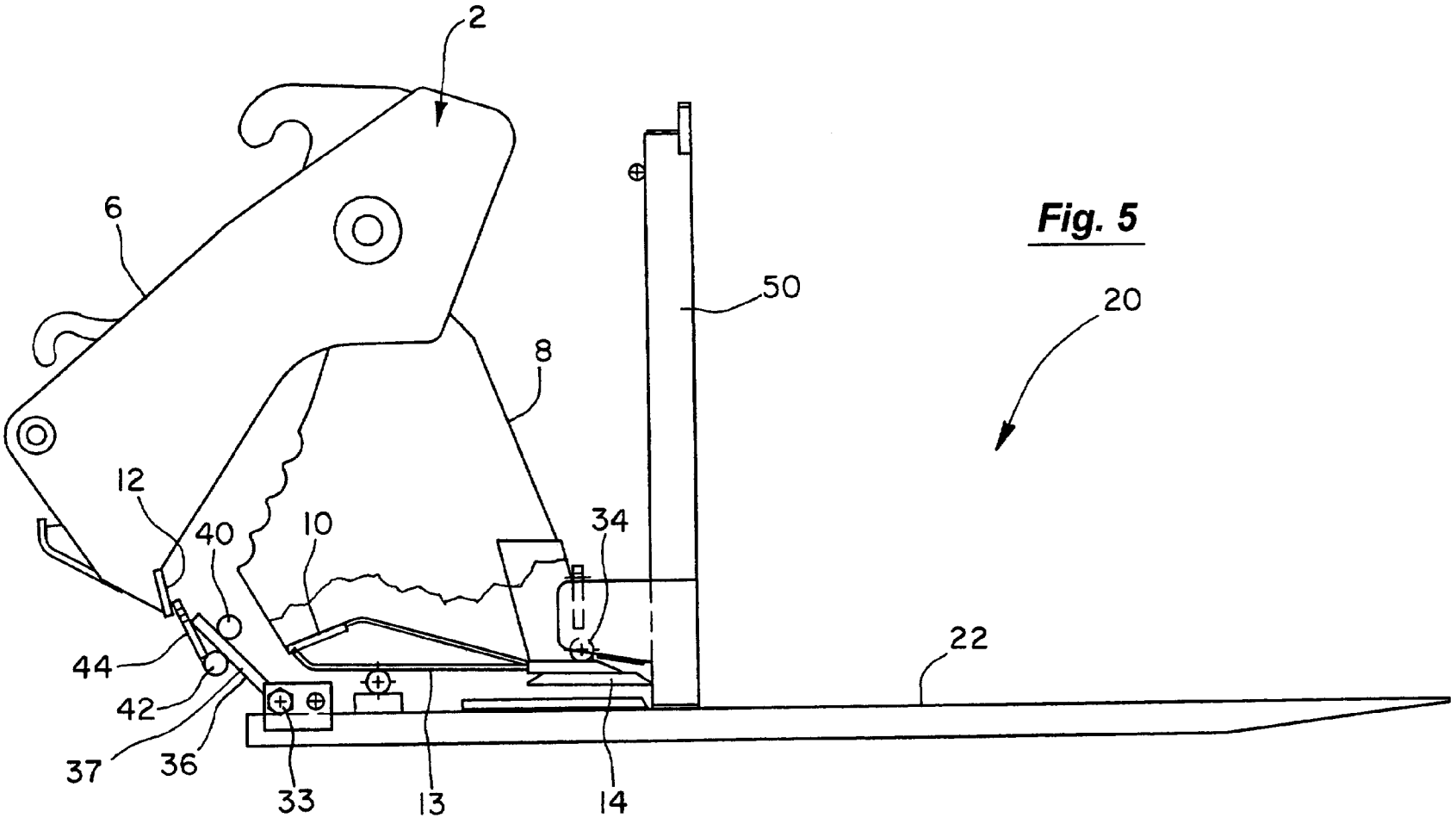
FIG. 5 as in FIG. 4 is a side view showing the installation process as the upper jaw of the bucket is first brought into contact with the latch of the fork lift attachment.
Figure 6:
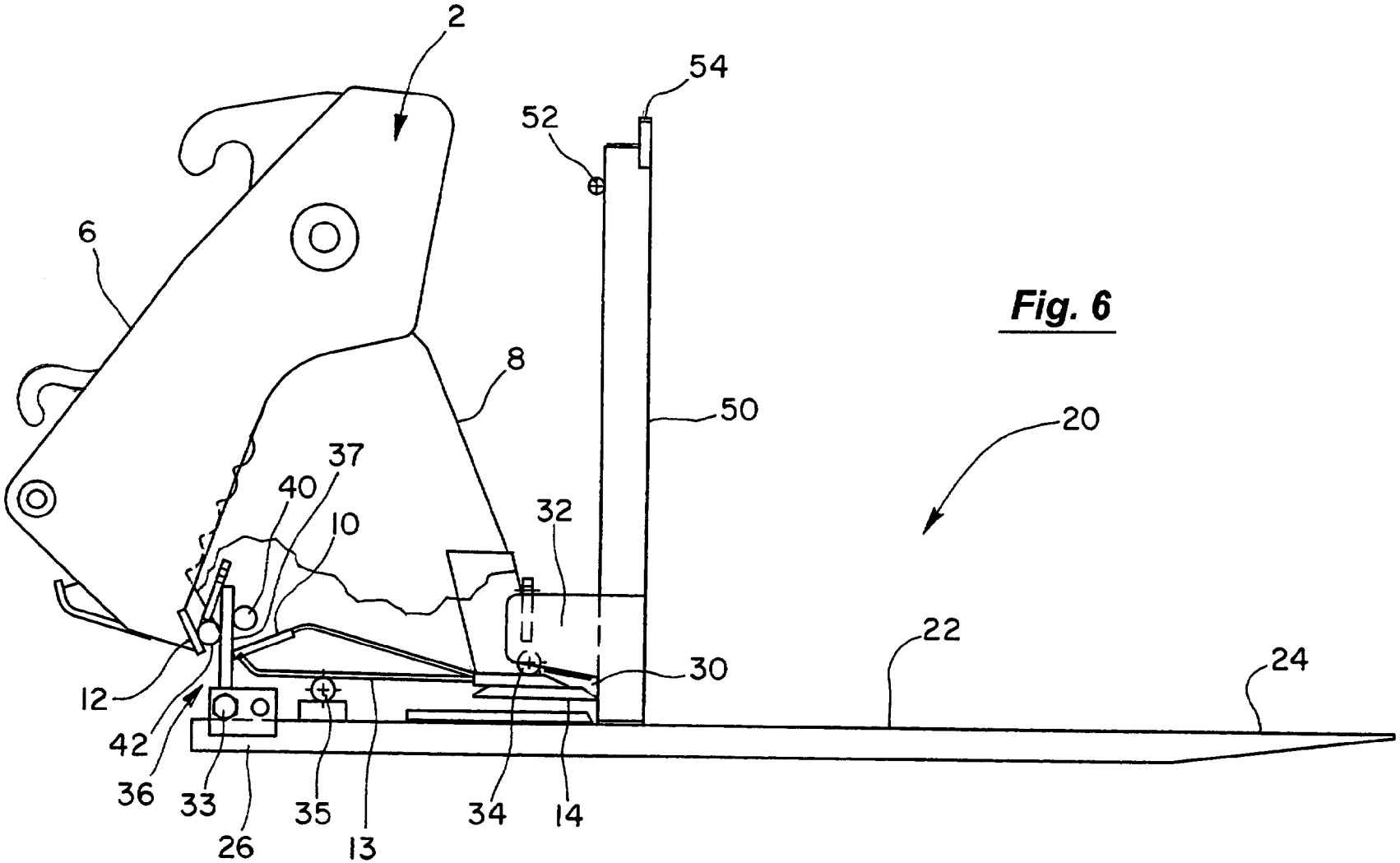
FIG. 6 like in FIG. 5 is a side view with the top jaw being closed onto the latch thus securing the fork lift attachment.

In the preferred embodiment, there are multiple hinge points such as 33 and 33*a* as in FIG. 3 to allow different locations of the latch 36*a*, 36*b*, or 36*c* and the adjustment of the fork lift attachment 20 to fit the length of the bottom surface 13 of the bottom jaw 8 from the leading edge 14 to the rear edge 10. In FIGS. 4, 5 and 6, the more rearward hinge point 33 is shown being used. In FIG. 4 a front bearing point 34 on the slot forming member 32 is illustrated which interacts with the top of the leading edge 14 of the bottom jaw 8 to transmit forces. Thus the downward forces transmitted to the bucket 2 during loading of the tines 22 are localized by the front bearing point 34 on the leading edge 14, where there is the greatest reinforcement and weight bearing ability.

The latch 36 in each of the preferred embodiments (e.g., see version 36*c* in FIG. 3) is composed of a steel flat 37 with a hinge collar 38 at one end. The flat 37 must be thick and strong enough to withstand bending forces that will occur when the leading edge 12 in FIG. 6 is forced against the rear contact point 42, which in turn will force the front surface of the flat 37 of the latch 36 to contact the rear edge 10 of the jaw 8. In the preferred embodiment, the rear contact point 42 in FIG. 6 is located farther from the hinge 33 than the front contact point between the flat 37 and the edge 10. This creates a fulcrum at the front contact point. By a lever action at the fulcrum point when the rear contact point is forced forward, the hinge 33 will be forced rearward. Also the latch 36 when forced upward will pull the attachment 20 and force the rear bearing point 35 against the bottom 13 of the bucket 2. This action cinches the attachment 20 to the bucket 2 and concentrates the forces at the bearing points 34 and 35.

On the front side of the latch 36 (see again as an example 36*c* in FIG. 3) is a safety stop 40. In the preferred embodiment the safety stop 40 is a rod or round stock welded on the front of the flat 37 of the latch 36. The stop may also be an extension 41, such as in version 36*a* in FIG. 3 designed for a specific bucket. Similarly the rear contact point 42 in the preferred embodiment is a rod or round stock welded on the rear face of the flat 37 of the latch 36. The rear contact point 42 interfaces with the leading edge 12 (see FIG. 6) so as to create a vector force generally forward on the flat 37.

Figure 7:
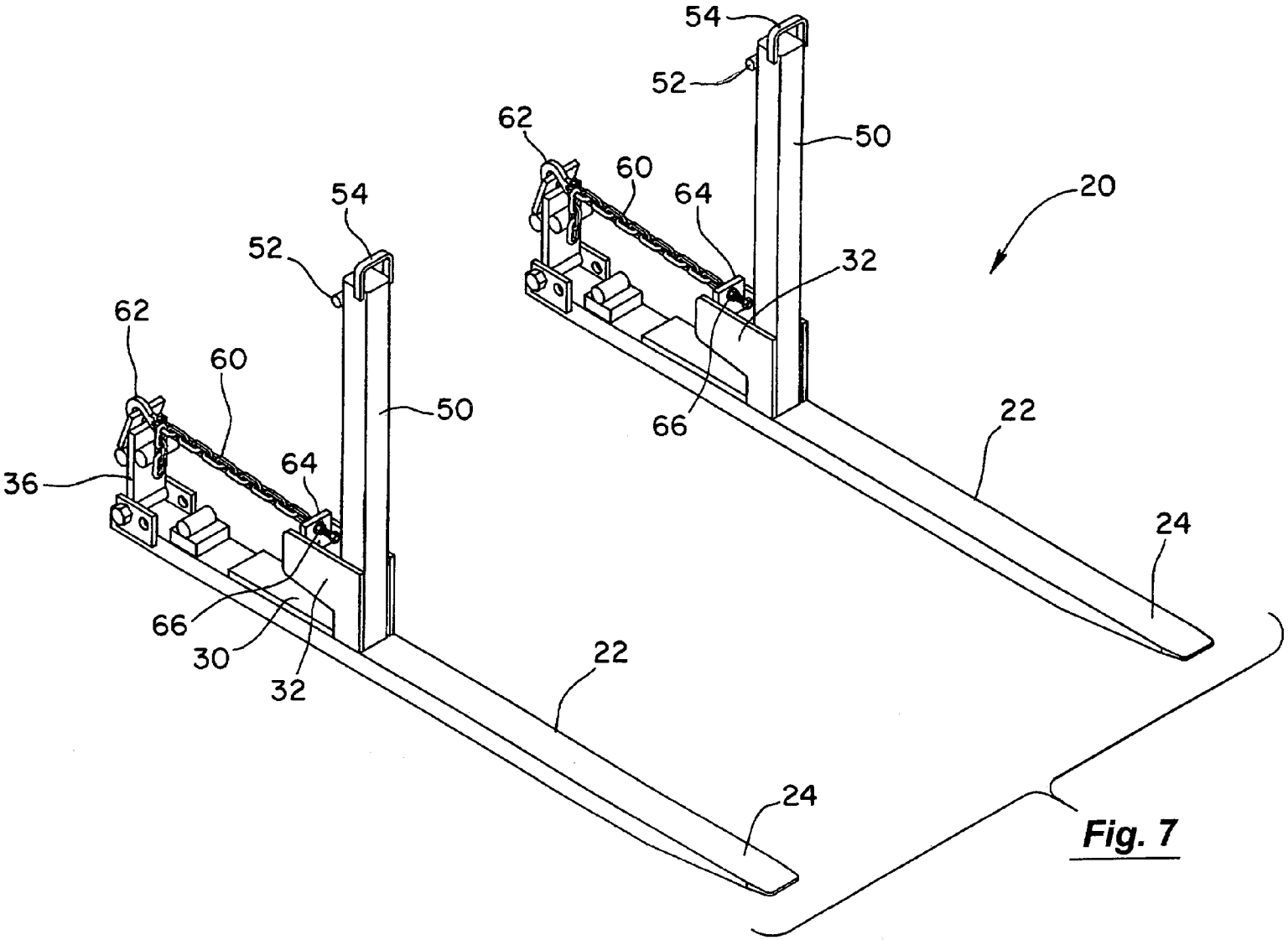
FIG. 7 illustrates two fork lift attachments with links or chains as visible safeties holding the latches in the position of installation as they would be in FIG. 6.
Figure 8:
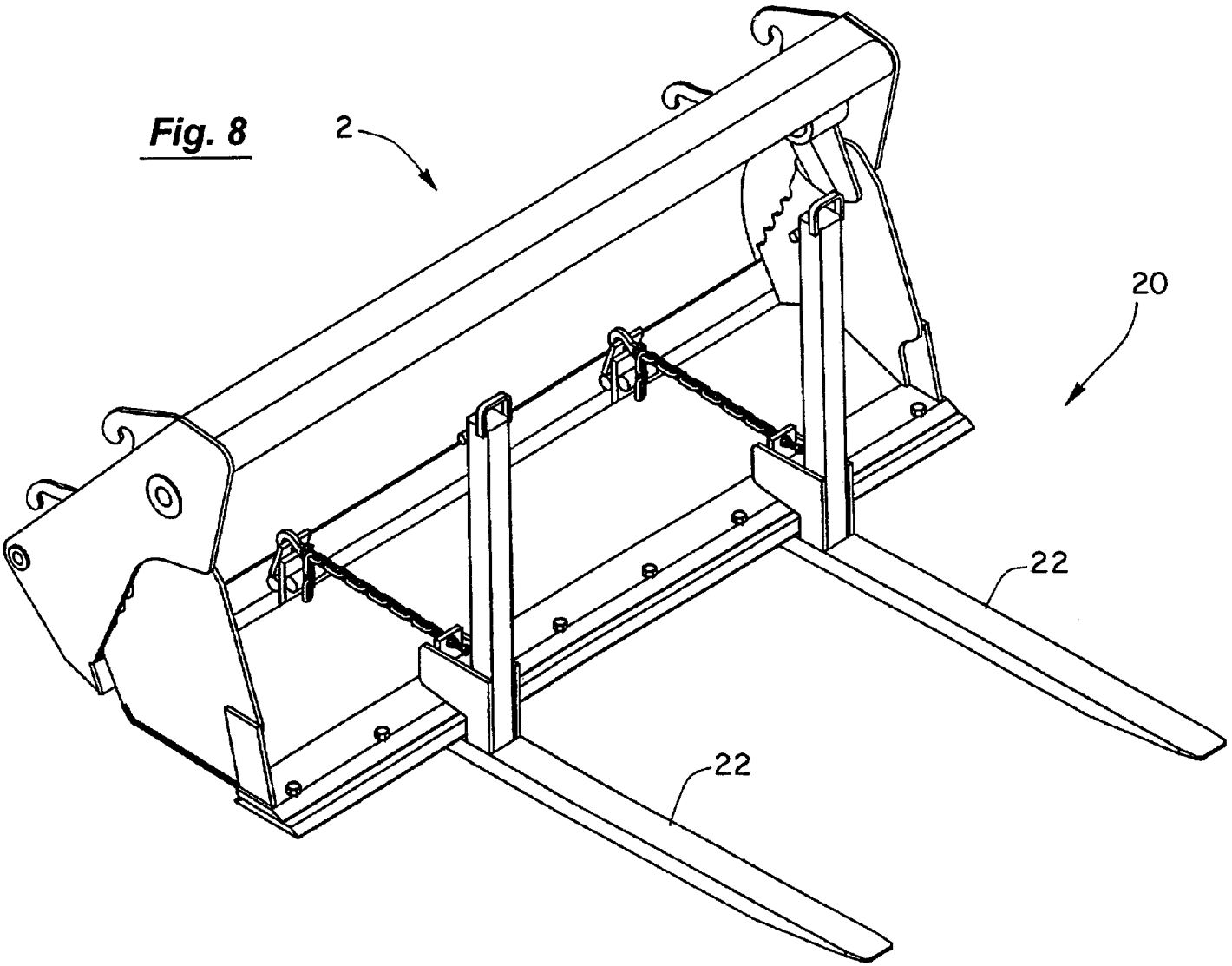
FIG. 8 illustrates a perspective view of two fork lift attachments installed on a multi-purpose bucket with the links in place as shown in FIG. 7.

A wedge piece 44 in the latch versions 36*a*, 36*b* and 36*c* of FIG. 3 is a flat piece welded to rear contact point 42 and to and extending beyond the top 43 as shown. The top 43 in this regard is the end of the flat 37 away from the hinge 38 of the latch 36. A hole 45 is broached into the end of the wedge 44 piece to accommodate the hook 62 (as shown in FIG. 7) on the safety link 60 as will be described in more detail below. This wedge 44 (see again FIG. 5) operates to allow the leading edge 12 of the top jaw 6 to smoothly engage the latch 36 and get into position against the rear contact point 42. As an alternative, the purpose and safety feature of the latch 36 may be accomplished by a single fabrication piece or a different configuration understood to accomplish the same or some of the functions described herein.

The installation of the fork lift attachment 20 onto a multi-purpose bucket 2 is progressively illustrated in FIGS. 4, 5 and 6 with FIG. 4 being a starting position.

FIG. 5 is a side view with the top jaw 6 of the bucket 2 closing on the bottom jaw 8 and first engaging the latch 36. As illustrated, leading edge 12 contacts the wedge 44 on the latch 36. This causes the latch 36 to rotate, clockwise in this view, about the hinge 33 and a front contact point of the flat 37 to move towards contact with edge 10.

FIG. 6 illustrates the latch 36 rotated about the hinge 33 as the front of the latch 36 at a front contact point on the flat 37 is forced against the rear edge 10 in response to the top jaw 6 forcing the rear contact point 42 forward. In FIG. 6 the latch 36 is held in this configuration by hydraulic forces causing the leading edge 12 of the top jaw 6 to contact the rear contact point 42 of the latch 36.

In FIG. 6 the latch 36 has a safety stop 40. The stop 40 acts as a safety to prevent the latch 36 from slipping down and out from the clamp of edge 12 and edge 10, due to any reverse loading on the tip 24 of the tines 22.

The rear contact point 42 by way of the hydraulic force through edge 12 causes rotational forces in the latch 36 about the fulcrum point of the front contact point of the flat 37 and edge 10. The force of edge 12 pushes against the rear contact point 42 and forces latch 36 forward. Since the latch 36 is attached to the heel 26 of the tine 22 at the hinge 33, the heel 26 of the tine 22 is pulled rearward with the rear bearing point 35 pressing against the bucket bottom surface 13 of the bucket 2. This, in turn, puts pressure on the fork lift attachment 20 to move the slot 30 backward against the leading edge 14 of the bucket 2. The force of the backward movement at the slot 30 is opposed by the edge 14 of the bottom jaw 8 of the bucket 2 against the top member 32 of the slot 30 and against the front bearing point 34. This series of actions acts as a cinch of the fork attachment 20 around the bottom surface 13 of the bucket 2 thus stabilizing the fork lift attachment 20.

The connection of the fork lift attachment 20 with the bucket 2 thus is accomplished with multiple securing techniques to stabilize the fork lift attachment 20 and form a rigid union between the fork lift attachment 20 and the multi-purpose bucket 2. The hydraulic controls of the multi-purpose bucket 2 cinch the connection and insure a rigid interaction between the components. The result is an efficient force transfer between the components during loading. The tight connection, forced by the hydraulics and the bearing points 34 and 35 and the rear contact point 42, insures that there is a rigid connection without any easy freedom of movement of the fork lift attachment 20 relative to the bucket 2. All of the benefits result without heavy or cumbersome plates or cross pieces, and without bolts or permanent alterations to the bucket 2.

Further, the installation can readily be accomplished by the operator as no parts of the fork lift attachment 20 need to be manually lifted into or onto the bucket 2. The tines 22 merely rest on the ground or platform and the bucket 2 by hydraulics is placed on the top side of the tines 22 to engage the slot 30 by the leading edge 14 of the bucket 2. The closing of the latch 36 and the cinching of the connection occurs by hydraulically controlling the closure of the multi-purpose bucket 2. The attachment is thus easily accomplished without any holes, bolts or heavy components.

A further improvement with added safety includes the adjustable link or chain 60 (see FIG. 7) from the slot forming member 32 to the latch 36. The link 60 in this embodiment is attached to the top of the slot forming member 32 and acts as another safety to prevent the latch 36 from moving open on the hinge 33 and thus, loosen or disengage from the rear edge 10 of the bucket 2. This could occur if the clamping action or hydraulic forces are lost or weak or unintentionally released allowing edge 12 to move away from the latch 36 or if the tines are reverse loaded. In the preferred embodiment, the adjustment at 64 is a bolt 66 welded to the end of the link 60 opposite the end with the hook 62 (in the illustration the link 60 is a chain). The bolt extends through the slot forming member 32 and is attached thereto with a nut that is used to shorten the total length of the link 60. The adjustment at 64 allows the link 60 to be attached to the latch 36 and then adjusted by shortening to provide a taut link. This minimizes any freedom in the attachment cinch. In the preferred embodiment the adjustment is a bolt, though any suitable adjuster could be used.

Another feature of the fork lift attachment 20 aids the fork lift function. In this regard vertical extensions 50 of the fork lift attachment 20 extend upward from the front of the slot 30. The extensions 50 operate as a load or cargo barrier or backstop to prevent loads, such as round stock or pipes and similar items from sliding or rolling into the bucket 2 when picked up and the fork lift tines 22 are rotated upward as is illustrated in FIG. 1. It also, at a suitable height, serves to allow the operator of the loader to see the location of the tine 22. This is necessary when the ends 24 of the tines 22 are not visible over the bucket 2 and load or other parts of the machine. The extensions 50 also have lifting aids 52 (see FIGS. 6 and 7) so that the extension 50 may be clamped and moved by the bucket 2 or moved by chains, ropes or by hand for positioning using handles 54.

While several embodiments of the present invention have been shown and described in detail, it is to be understood that various changes and modifications could be made without departing from the scope of the invention.

We claim:

1. A fork attachment for use with a multi-purpose bucket to convert the bucket into a forklift, said bucket having at least two jaws pivotally mounted to each other with at least one of the jaws having a leading edge, said fork attachment comprising:

(a) a fork tine having a forward part, a rear part and a top side;

(b) at least one member forming a rear facing slot adjacent the top side of said tine to engage the leading edge of the one jaw of said bucket therein, and (c) a pivoting latch secured in the jaw of the bucket and attached to the tine to resist movement of the tine relative to the one jaw of said bucket away from engagement of said leading edge in said slot.

2. The fork attachment of claim 1 wherein the latch is removably attached adjacent the slot forming member.

3. The fork attachment of claim 1 wherein the latch is removably attached to said tine.

4. The fork attachment of claim 1 wherein the latch is positioned on the top side of the tine.

5. The fork attachment of claim 4 wherein the one jaw has a rear edge and the latch is positioned to engage the rear edge of the one jaw of said bucket.

6. The fork attachment of claim 5 wherein the latch is hinged to allow the latch to move to engage the rear edge of the one jaw of said bucket.

7. The fork attachment of claim 1 wherein the latch is positioned to be clamped between the two jaws of the bucket.

8. The fork attachment of claim 1 wherein the latch is rotatably mounted to the tine and has a rear surface with a rear contact point and a front surface with a front contact point and wherein the force of the second jaw of the bucket against the rear surface of the latch causes the front contact point of the latch to engage the one jaw of the bucket.

9. The fork attachment of claim 8 wherein the latch is rotatably mounted to the tine by a hinge and the rear contact point is farther from the binge than the front contact point.

10. The fork attachment of claim 1 wherein the tine has a hinge attached to its rear part and wherein the latch has a rear contact point and the latch is attached to the slot forming member by a link extending therebetween, and the attachment point of the link to the latch is at a location farther from the hinge than the rear contact point of the latch is from the hinge.

11. The fork attachment of claim 10 wherein the link is adjustable.

12. The fork attachment of claim 1, wherein the latch has a front side facing the tine, and a back side, and wherein the latch has a safety stop on the front side of the latch.

13. The fork attachment of claim 1 wherein the tine has at least two hinge points on its rear part and wherein the latch is selectively attachable to the tine at at least the two locations of the hinge points.

14. The fork attachment of claim 1 further including a rear bearing point on the top side of the tine for engagement with the one jaw of said bucket.

15. The fork attachment of claim 1 further including a front bearing point on the slot forming member for engagement with the one jaw of said bucket.

16. The fork attachment of claim 1 further including a vertical extension extending upward from adjacent the slot forming member and not attached to said bucket, whereby the vertical extension acts as a backstop to stabilize a load carded on the tine or tines, and as a visual aid to the operator of the bucket to help determine the location of the tine when picking up a load.

17. The fork attachment of claim 16 wherein the vertical extension further includes a lifting aid.

* * * * *